US008696608B2

(12) United States Patent
Numata et al.

(10) Patent No.: US 8,696,608 B2
(45) Date of Patent: Apr. 15, 2014

(54) LOWER LEG MASSAGE APPARATUS

(75) Inventors: Koichi Numata, Higashi-Osaka (JP); Teruo Mihara, Higashi-Osaka (JP); Shinsaku Shimizu, Higashi-Osaka (JP); Shigeki Noda, Higashi-Osaka (JP)

(73) Assignee: Daito Electric Machine Industry Company Limited, Osaka (JP)

( * ) Notice: Subject to any disclaimer, the term of this patent is extended or adjusted under 35 U.S.C. 154(b) by 687 days.

(21) Appl. No.: 12/866,549

(22) PCT Filed: Jan. 23, 2009

(86) PCT No.: PCT/JP2009/051057

§ 371 (c)(1),
(2), (4) Date: Aug. 23, 2010

(87) PCT Pub. No.: WO2009/113331

PCT Pub. Date: Sep. 17, 2009

(65) Prior Publication Data

US 2010/0318004 A1 Dec. 16, 2010

(30) Foreign Application Priority Data

Mar. 14, 2008 (JP) ..... P2008-065570
Aug. 25, 2008 (JP) ..... P2008-215353
Dec. 16, 2008 (JP) ..... P2008-319656

(51) Int. Cl.
*A61H 7/00* (2006.01)
*A61H 9/00* (2006.01)

(52) U.S. Cl.
USPC ..... 601/148; 601/16; 601/27; 601/90; 601/93; 601/105

(58) Field of Classification Search
USPC ..... 601/16, 148–152, 26–32, 90, 93, 96, 601/104–105, 133, 134
See application file for complete search history.

(56) References Cited

U.S. PATENT DOCUMENTS 4,614,179 A * 9/1986 Gardner et al. ..... 601/30
6,491,652 B1 * 12/2002 Hata et al. ..... 601/151
6,632,188 B2 * 10/2003 Thomas et al. ..... 601/152
7,195,604 B2 * 3/2007 Nakamura et al. ..... 601/136
2006/0189905 A1 * 8/2006 Eischen, Sr. ..... 601/152

(Continued)

FOREIGN PATENT DOCUMENTS

JP 58-160027 U 10/1983
JP 11-128291 A 5/1999

(Continued)

OTHER PUBLICATIONS

Partial English translation for JP-58-160027 published Oct. 25, 1983.

*Primary Examiner* — Patricia Bianco
*Assistant Examiner* — Kari Petrik
(74) *Attorney, Agent, or Firm* — Birch, Stewart, Kolasch & Birch, LLP

(57) ABSTRACT

An objective is to perform a leg massage under appropriate temperature conditions. The lower leg massage apparatus 1 comprises: a pair of right and left insertion recesses 4,4 in a vertically-extending continuous form, into which are inserted feet F and calves C of a user; a first massage mechanism 5 disposed within an upper part of the insertion recess 4, for massaging the inserted calves C, and a second massage mechanism 7 disposed within a lower part of the insertion recess 4, for massaging the inserted feet F. Further provided are a cover body 12 of a two-layer structure which is disposed in the insertion recess 4 so as to cover the first massage mechanism 5 and the second massage mechanism 7, and a warm air/cool air supply section 15 for supplying a warm or cool current of air to a region between the two layers constituting the cover body 12.

19 Claims, 14 Drawing Sheets

(56) References Cited

U.S. PATENT DOCUMENTS

2007/0021694 A1 1/2007 Shiraishi

FOREIGN PATENT DOCUMENTS

JP 11-347083 A 12/1999
JP 2000-316932 A 11/2000
JP 2001-120618 A 5/2001
JP 2006-204474 A 8/2004
JP 2007-68663 A 3/2007
KP 20050007993 A 1/2005
KP 20-0427267 Y1 9/2006
WO WO 2005/023169 A1 3/2005

* cited by examiner

LOWER LEG MASSAGE APPARATUS

CROSS-REFERENCE TO RELATED APPLICATIONS

The present patent application is a national stage entry of PCT/JP/051057 filed Jan. 23, 2009 and claims the benefit of foreign Patent Applications JP2008-319656 filed Dec. 16 2008, JP2008-215353 filed Aug. 25 2008, and JP 2008-065570 filed Mar. 14 2008.

TECHNICAL FIELD

The present invention relates to a lower leg massage apparatus.

BACKGROUND ART

Lower leg massage apparatuses capable of massaging not only the back of a human body but also the lower legs of a human body have been developed to date. By way of example, a lower leg massage apparatus presented in Patent document 1 is composed of: a leg rest portion having a built-in first massage mechanism for massaging the calves of, respectively, a right leg and a left leg; a foot rest portion disposed at the side of the front end of the leg rest portion, which has a built-in second massage mechanism for massaging the feet of, respectively, a right leg and a left leg; and a driving mechanism disposed centrally of the leg rest portion and/or the foot rest portion as seen in a right-left direction, which drives both of the massage mechanisms at the same time. The lower leg massage apparatus is capable of massaging the calves and feet of a user with a high degree of effectiveness. Patent document 1: WO2005/023169

DISCLOSURE OF THE INVENTION

Problems to be Solved by the Invention

However, user's recent demands for massage apparatuses are quite wide-ranging. For example, there are demands for the capability of massaging lower legs while warming them up. There are also demands for handling of a complaint about uncomfortable warmth around lower legs encountered in the use of a massage apparatus such as disclosed in Patent document 1 during the summer months.

The present invention has been devised in view of the above-described problems, and accordingly its object is to provide a lower leg massage apparatus capable of temperature control at a part for receiving lower legs.

Means for Solving the Problems

In order to accomplish the object, the present invention provides the following means.

That is, the present invention provides a lower leg massage apparatus comprising a pair of right and left insertion recesses into which the lower legs of a user are insertable and a massage mechanism disposed within the insertion recess, for massaging the inserted lower leg. In this construction, a cover body of a two-layer structure is disposed in the insertion recess so as to cover the massage mechanism, and a warm air/cool air supply section is provided to supply a warm or cool current of air to a region between the two layers constituting the cover body.

Moreover, the present invention provides a lower leg massage apparatus comprising a pair of right and left insertion recesses designed in a vertically-extending continuous form, into which the feet and calves of a user are insertable, a first massage mechanism disposed within an upper part of the insertion recess, for massaging the inserted calf, and a second massage mechanism disposed within a lower part of the insertion recess, for massaging the inserted foot. In this construction, a cover body of a two-layer structure is disposed in the insertion recess so as to cover the first massage mechanism and the second massage mechanism, and a warm air/cool air supply section is provided to supply a warm or cool current of air to a region between the two layers constituting the cover body.

An auxiliary massage mechanism for massaging the sole of the inserted lower leg may be disposed within a bottom part of the insertion recess.

In this case, it is advisable that the auxiliary massage mechanism is disposed between the two layers constituting the cover body.

Preferably, the cover body consists of an upper cloth body and a lower cloth body placed beneath the upper cloth body, and the warm air/cool air supply section has an outlet which is positioned so as to be capable of directing an issue of a warm or cool current of air into a region between the upper cloth body and the lower cloth body.

It is advisable that the outlet for a warm current of air is provided with a flow guide portion for allowing an issue of a warm current of air to be directed into the space area between the upper cloth body and the lower cloth body of the cover body.

More preferably, the warm air/cool air supply section is interposed between a pair of the right and left insertion recesses.

It is advisable that the upper cloth body is made pervious to a warm or cool current of air supplied from the warm air/cool air supply section.

The upper cloth body may be made impervious to a warm or cool current of air supplied from the warm air/cool air supply section.

The upper cloth body may be so designed that that part thereof which faces the foot of the lower leg inserted in the insertion recess is made pervious to a warm or cool current of air supplied from the warm air/cool air supply section and the rest part is made impervious to the warm or cool current of air.

The cover body may be provided with an opening for dissipating a warm or cool current of air supplied from the warm air/cool air supply section.

The insertion recess may consist of an upper-located first insertion recess and a lower-located second insertion recess, and the cover body may cover the first insertion recess and the second insertion recess either in a separate manner or in an integral manner.

The insertion recess may be provided with a front-part cover body for covering the foot of the inserted lower leg.

The insertion recess may be provided with a replacement cover body which covers the cover body of a two-layer structure from above and is made replaceable.

In order for the lower legs to be inserted from the rear, the insertion recess may be disposed in an open form on the rear side, and a lower part of an inner wall of the insertion recess may be formed as a cover body for covering the foot of the inserted lower leg.

Advantages of the Invention

The use of the lower leg massage apparatus pursuant to the present invention makes it possible to massage lower legs under appropriate temperature conditions.

EXPLANATION OF REFERENCES

Figure 1:
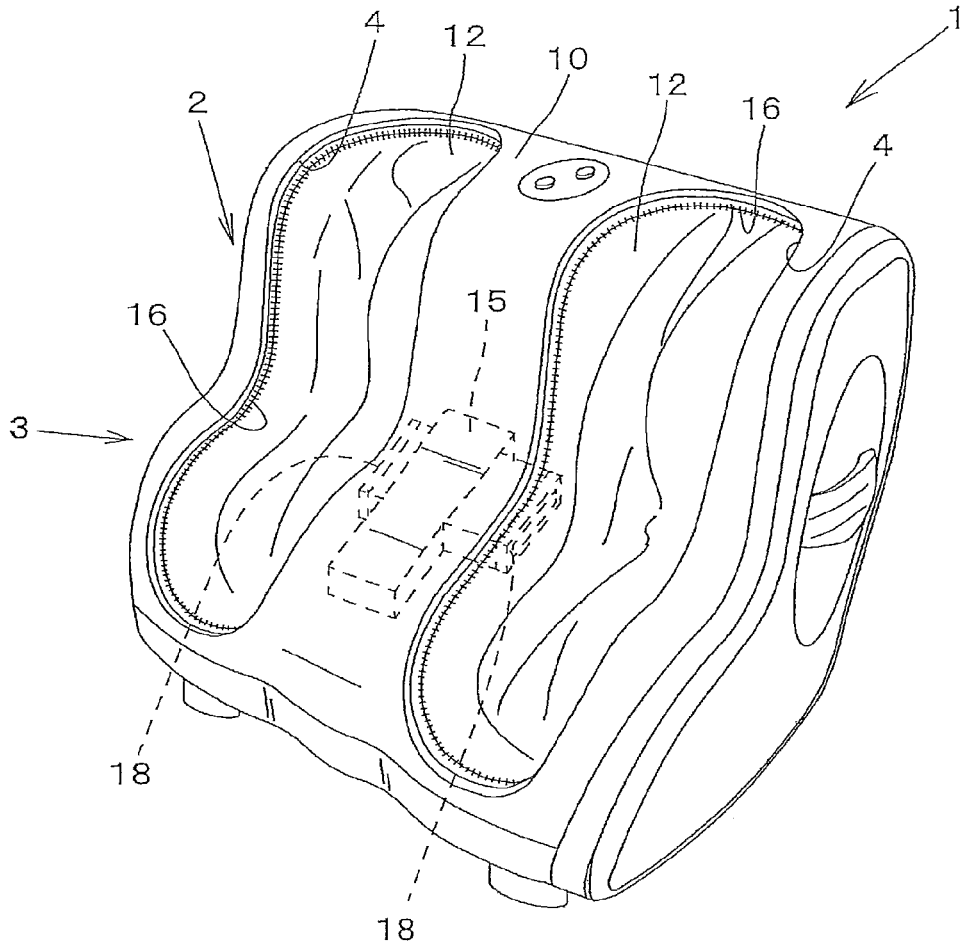
FIG. 1 is a perspective view of a lower leg massage apparatus in accordance with a first embodiment.

1 Lower leg massage apparatus
2 Leg rest portion
3 Foot rest portion
4 Insertion recess
4U First insertion recess
4D Second insertion recess
5 Leg massage mechanism (First massage mechanism)
6 Calf massage member
7 Foot massage mechanism (Second massage mechanism)
8 Foot massage member
9 Driving mechanism
10 Casing
11 Electric motor
12 Cover body
13 Upper cloth body
14 Lower cloth body
15 Warm air/cool air supply section
16 Connecting means
17 Opening
18 Outlet
20 Rotary shaft
21 Rotating body
22 Engagement pin
23 Sliding groove
24 Support bracket
25 Boss part
30 Chair-type massage apparatus
31 Seat portion
32 Leg portion
33 Seatback portion
40 Auxiliary massage mechanism
41 Front-part cover body
42 Front protrusion group
43 Projecting support
44 Rear protrusion group
45 Vibrating plate
47 Replacement cover body
48 Inner wall (of the insertion recess)
48*a* Front-part cover portion
50 Flow guide portion
51 Fin
L Lower leg
C Calf
F Foot

BEST MODE FOR CARRYING OUT THE INVENTION

[First Embodiment]

In FIGS. 1 to 4, there is shown a first embodiment of a lower leg massage apparatus pursuant to the present invention. The lower leg massage apparatus 1 in accordance with the first embodiment includes a leg rest portion 2 having insertion recesses 4 for insertion of right and left calves C and a foot rest portion 3 disposed at the side of the front end of the leg rest portion 2 and having insertion recesses 4 for insertion of right and left feet F. The insertion recess 4 formed in the leg rest portion 2 and the insertion recess 4 formed in the foot rest portion 3 are continuous with each other, and the leg rest portion 2 and the foot rest portion 3 are formed integral with each other, so that a lower leg L can be put into the insertion recess 4. Thus, the lower leg massage apparatus 1 has a substantially L-shaped profile when viewed from the side.

The leg rest portion 2 acts to massage the calf C of a user and thus has a leg massage mechanism 5 (first massage mechanism) for massaging the calf C. At the front face of the leg rest portion 2 are formed the insertion recesses 4, 4 into which the right and left calves C are insertable. Calf massage members 6 are arranged on widthwise opposite side faces of the interior of the insertion recess 4 in the leg rest portion 2 so as for the calf C to be sandwiched between them. The foot rest portion 3 acts to massage the foot F of the user and thus has a foot massage mechanism 7 (second massage mechanism) for massaging both sides of the foot F. At the front face (top face) of the foot rest portion 3 are formed the insertion recesses 4 into which the feet F are insertable. Foot massage members 8 are arranged on widthwise opposite side faces of the interior of the insertion recess 4 in the foot rest portion 3.

It is noted that, as employed in the present specification, "lower leg L" refers to part of a human leg below the knee. Moreover, the following description will be presented on the understanding that the lower leg L is divided into a "calf C" which is a part below the knee but above the ankle and a "foot F" which is a part below the ankle. Further, for the purpose of explanation, the direction of from right to left of FIG. 2 will be termed "the right-left direction" or "the widthwise direction", the direction of from top to bottom of FIG. 2 will be termed "the vertical direction", and the direction of drilling through the paper sheet bearing FIG. 2 will be termed "the front-rear direction". Thereby defined directions conform to the front-rear direction, the horizontal direction, and the vertical direction as viewed through the eyes of the user sitting with his/her lower legs put in the lower leg massage apparatus 1.

Figure 2:
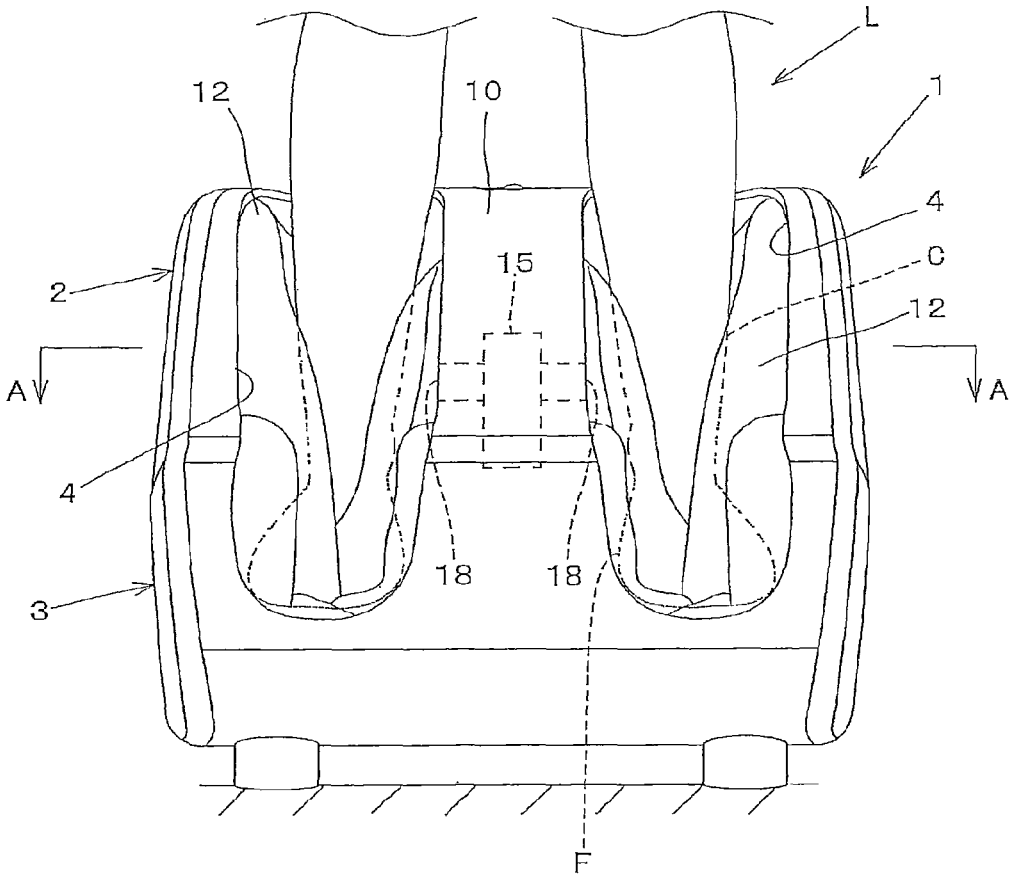
FIG. 2 is a front view of the lower leg massage apparatus in accordance with the first embodiment.
Figure 3:
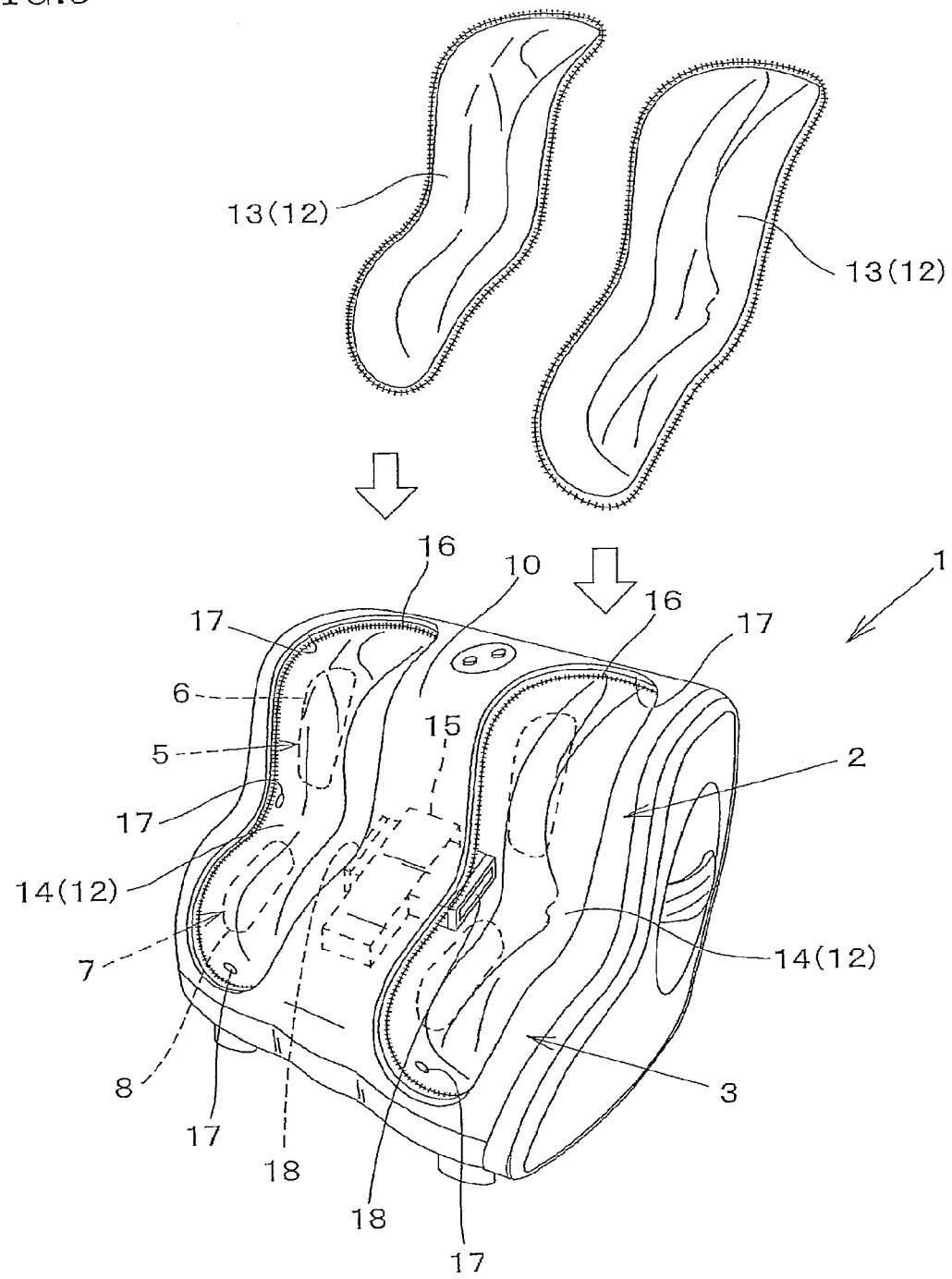
FIG. 3 is an exploded perspective view of the lower leg massage apparatus in accordance with the first embodiment.
Figure 4:
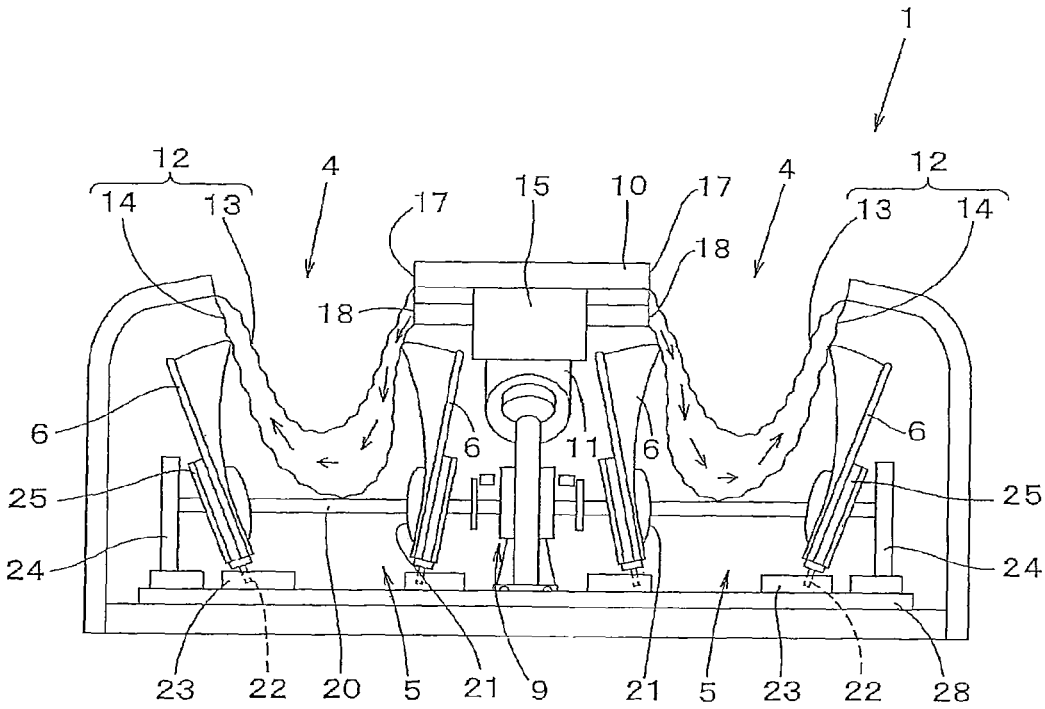
FIG. 4 is a sectional view of the lower leg massage apparatus taken along the line A-A shown in FIG. 2.

As shown in FIGS. 1 to 4, the lower leg massage apparatus 1 includes the leg massage mechanism 5, the foot massage mechanism 7, and a driving mechanism 9 for driving both of the massage mechanisms 5 and 7. The driving mechanism 9 and the massage mechanisms 5 and 7 are housed in a single casing 10. At the front face of the casing 10 are formed openings each extending along the length of a lower leg to be inserted, and the aforestated insertion recess 4 is formed by placing a cover body 12 over this opening. As shown in FIGS. 3 and 4, the cover body 12 consists of an upper cloth body 13 and a lower cloth body 14 placed beneath the upper cloth body 13 thereby to take on a two-layer structure. The upper cloth body 13 and the lower cloth body 14 are each made of an elasticized or flexible cloth, an artificial leather, a leather, or the like. Temperature-adjusted air (a warm or cool current of air) supplied from a warm air/cool air supply section 15 as will hereafter be described finds its way into a region between the upper cloth, body 13 and the lower cloth body 14.

The upper cloth body 13 and the lower cloth body 14 have substantially the same shape. The lower cloth body 14 is, at its peripheral edge, fixedly attached to the casing 10 along the edge of the insertion recess 4. The upper cloth body 13 is, at its peripheral edge, detachably attached to the edge of the lower cloth body 14 by connecting means 16 such as a fastener. It is advisable that the lower cloth body 14 is made of a material impervious to a warm or cool current of air supplied from the warm air/cool air supply section 15. This helps prevent the escape of an admitted warm or cool current of air into the casing 10. That is, when supplied air is a warm current of air, a decrease of the internal temperature of the cover body 12 can be prevented. However, there is no problem with the lower cloth body 14 being made of a material pervious to a warm or cool current of air supplied from the warm air/cool air supply section 15.

The upper cloth body 13 may be either rendered pervious to a warm or cool current of air or formed of a material impervious to a warm or cool current of air, in so far as it is capable of transmitting the heat of a warm or cool current of air to the foot F and calf C inserted in the insertion recess 4. In the case where the upper cloth body 13 is made of a material impervious to a warm or cool current of air, it is advisable to provide an opening 17 in one of the constituent bodies of the cover body 12, viz., the upper cloth body 13 and/or the lower cloth body 14, to let air supplied from the warm air/cool air supply section 15 escape. It is preferable that the opening 17 is of such size as to attain, at the time of supplying a warm or cool current of air to the region between the upper cloth body 13 and the lower cloth body 14, "the amount of air leaks" which allows the cover body 12 to inflate like a balloon, with consequent inflation of the upper cloth body 13 so that the lower legs of the user can be wrapped therein.

The warm air/cool air supply section 15 for supplying a warm or cool current of air to the region between the two layers constituting the cover body 12 is attached to the casing 10 interiorly thereof. The warm air/cool air supply section 15 is located between a pair of the insertion recesses 4, is located substantially centrally of the casing 10 in the vertical direction, and is disposed at the side of the back surface of the casing 10. Specifically, the warm air/cool air supply section 15 includes a heater portion and an air-feeding portion for generating air which is supplied by way of the heater portion. The air-feeding portion is constructed for example of a fan and an electric motor for turning the fan. Air produced by the air-feeding portion, now in a high-temperature state after having passed through the heater portion (a warm current of air) or air produced by the air-feeding portion, now still in a room-temperature state after having passed through the inoperative heater portion (a cool current of air) is caused to issue from an outlet 18 disposed in the space area between the upper cloth body 13 and the lower cloth body 14. The outlet 18 is disposed in each of the paired right and left insertion recesses 4, 4. For example, the outlet 18 is located between the insertion recesses 4, 4 and is disposed substantially centrally of the casing 10 in the vertical direction.

However, the position of placement of the outlet 18 is not so limited. For example, the outlet 18 may be formed either at the front end of the insertion recess 4 (that is, a part facing with the front end of the foot F) or at the bottom of the insertion recess 4 (that is, a part facing with the sole of the foot F and the back of the calf C). In another alternative, the outlet 18 may be formed on the widthwise outer side of each insertion recess 4. As the leg massage mechanism 5 and the foot massage mechanism 7, those of various forms, for example, the one such as described hereunder, can be adopted for use. The leg massage mechanism 5 is composed of a pair of right and left calf massage members 6, a rotary shaft 20 which is rotated by the driving mechanism 9, a rotating body 21 secured to the rotary shaft 20, to which is fitted the calf massage member 6 for free relative rotation, an engagement pin 22 for restraining the calf massage member 6 from rotating in conjunction with the rotating body 21, and a sliding groove 23.

The rotary shaft 20 is supported for free rotation by support brackets 24 disposed on both sides thereof in the widthwise direction. The rotating body 21 is secured to a position partway along the length of the rotary shaft 20. On the peripheral surface of the rotating body 21 is formed a substantially circular track having its axis inclined with respect to the rotary shaft 20. A boss part 25 of the calf massage member 6 is fitted in the track for sliding movement. Note that the rotating bodies 21 are secured to the rotary shaft 20 in such a manner that the track of the right-hand rotating body 21 and the track of the left-hand rotating body 21 are opposite in inclination direction to each other. Disposed below the boss part 25 is the engagement pin 22 protruding downward. The engagement pin 22 is fitted for free sliding movement in the sliding groove 23 formed in a support body 28. The sliding groove 23 is so formed as to extend in the right-left direction, for guiding the calf massage member 6 in the right-left direction and restraining the calf massage member 6 from rotating in conjunction with the rotating body 21 through the engagement with the engagement pin 22.

The calf massage member 6 is constructed of a long platy member extending along the calf C inserted in the insertion recess 4. The calf massage member 6 is made of an elastic body such as a plastic or a resilient body such as a leaf spring, and is thus rendered elastically/resiliently deformable in its through-thickness direction, viz., a direction away from the calf C. The foot massage mechanism 7 is composed of a foot massage member 8, a rotary shaft 20 which is rotated by the driving mechanism 9, a rotating body 21 secured to the rotary shaft 20, to which is fitted the foot massage member 8 for free relative rotation, an engagement pin 22 for restraining the foot massage member 8 from rotating in conjunction with the rotating body 21, and a sliding groove 23. Note that these constituent components are similar in structure to those of the aforestated leg massage mechanism 5, and therefore the descriptions thereof will be omitted.

The driving mechanism 9 for driving both of the massage mechanisms 5 and 7 is so disposed as to be located substantially centrally of the massage mechanisms in the front-rear direction, as well as to be located substantially centrally of the construction in the right-left direction. The driving mechanism 9 has a single electric motor 11, and the rotation of the output shaft of the electric motor 11 is transmitted to the rotary shaft 20 of the leg massage mechanism 5 as well as the foot massage mechanism 7. Now, a mode of use of the lower leg massage apparatus 1 thus far described will be discussed. To begin with, as shown in FIG. 2, the user inserts his/her lower legs L, L into the paired right and left insertion recesses 4, 4, respectively. After that, the lower leg massage apparatus 1 is set in motion, whereupon the calf massage members 6 of the leg massage mechanism 5 apply pressure to the calf C sandwiched between them for giving a kneading massage to the calf C. At the same time, the foot massage members 8 of the foot massage mechanism 7 apply pressure to the foot F area sandwiched between them for giving a kneading massage to the foot F.

At this time, as shown in FIG. 4, a warm current of air is supplied from the warm air/cool air supply section 15, and the interior of the cover body 12 (that is, the region between the upper cloth body 13 and the lower cloth body 14) is then filled with the warm current of air that passed through the outlet 18. As the warm current of air is delivered, so the upper cloth body 13 is inflated like a balloon while moving away from the lower cloth body 14, with the consequence that the lower leg L inserted in the insertion recess 4 is wrapped in the upper cloth body 13. Moreover, the warm current of air is allowed to reach the lower leg L through the upper cloth body 13, so that the lower leg L can be warmed up. In regard to this warming action, even if the upper cloth body 13 is made of a material impervious to the warm current of air, substantially the same effect can be obtained; that is, the heat of a warm current of air from the cover body 12 propagates through the upper cloth body 13 and eventually reaches the lower leg L.

By virtue of such a mode of operation, the user is given a kneading massage treatment with his/her lower legs L kept warmed, and is thus able to enjoy a massage with a high degree of effectiveness. Note that a warm current of air delivered into the cover body 12 is discharged into the casing 10 through the opening 17 formed in the lower cloth body 14. This makes it possible to protect the cover body 12 from rupture, as well as to allow the cover body 12 to be filled with a warm current of air having an adequately high temperature supplied from the warm air/cool air supply section 15 at all times. Even if the opening 17 is not provided, for example, a warm current of air leaks from the connecting means 16 for providing mutual attachment between the upper cloth body 13 and the lower cloth body 14. This makes it possible to protect the cover body 12 from damage such as rupture.

When the lower leg massage apparatus 1 of the first embodiment is used during the summer months, it is advisable to turn off the heater portion of the warm air/cool air supply section 15 so that unheated air can be supplied through the outlet 18. Since this air serves as a cool current of air, it follows that the user is able to enjoy a leg massage in a comfortable condition without feeling excessive heat and stuffiness. Moreover, an air cooling portion constructed for example of a Peltier element may be provided instead of the heater portion. In this case, a cool current of air is produced by causing air from the air-feeding portion to pass through the said air cooling portion. Note that the leg massage mechanism 5, as well as the foot massage mechanism 7, and the warm air/cool air supply section 15 do not necessarily have to be operated concurrently. There is no problem with these components being designed to be operated independently of each other. In this case, when only the warm air/cool air supply section 15 is activated, the apparatus serves as a leg heating apparatus.

[Second Embodiment]

Figure 5:
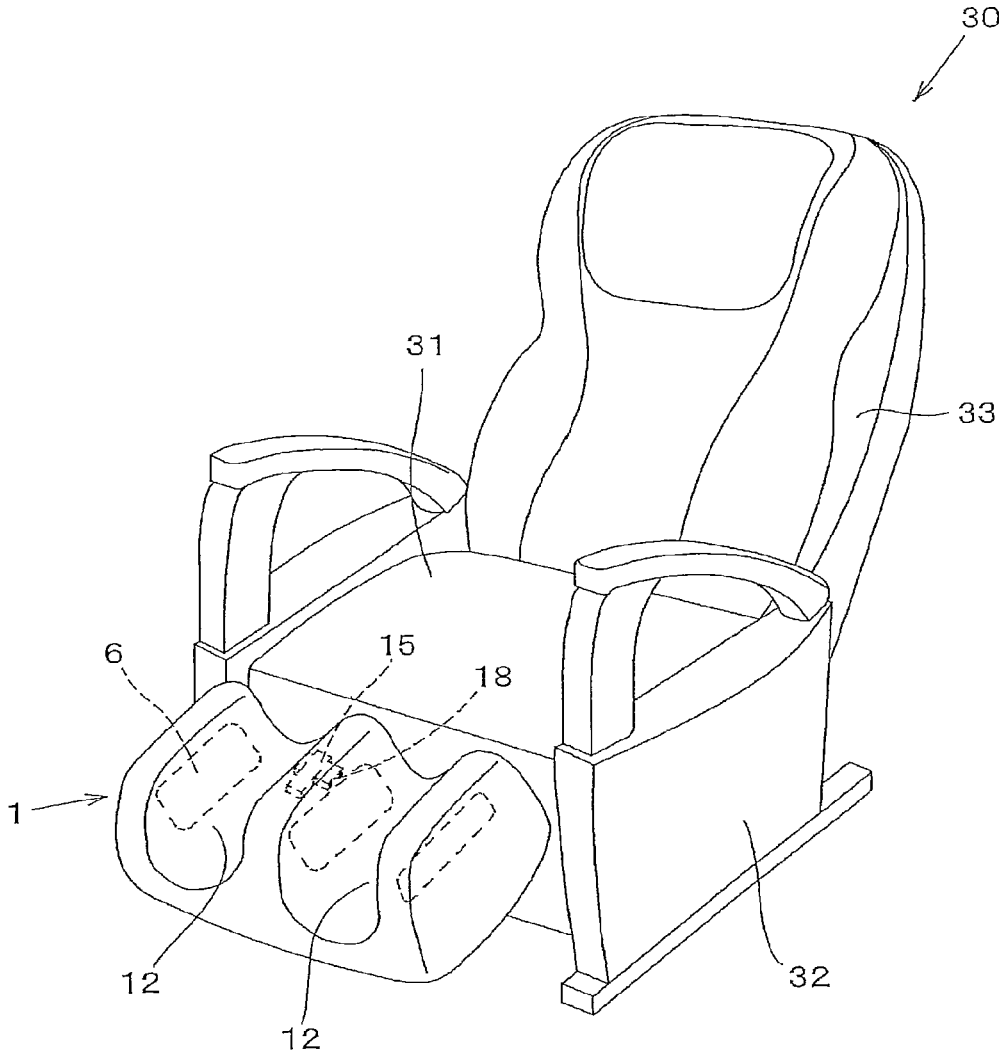
FIG. 5 is a perspective view of the lower leg massage apparatus in accordance with a second embodiment.

In FIG. 5, there is shown a second embodiment of the lower leg massage apparatus pursuant to the present invention.

In the second embodiment, the lower leg massage apparatus 1 pursuant to the present invention is implemented by way of a foot rest of a chair-type massage apparatus 30. The chair-type massage apparatus 30 is composed of: a seat portion 31 for supporting the buttocks of a human body from below; leg portions 32 for supporting the seat portion 31; and a seatback portion 33 coupled to the rear end of the seat portion 31. The seatback portion 33 has a built-in back massage mechanism capable of performing a kneading or tapping massage that is free to move upward and downward. The seat portion 31 has a built-in reclining mechanism for changing the angle of inclination of the seatback portion 33. It is advisable that, at the front of the seat portion 31, the lower leg massage apparatus 1 is, at its upper part, coupled to the front part of the seat portion 31 for free rotation about a right-left axis.

The user sitting on the seat portion 31 is able to enjoy a massage to the calves C and the feet F performed by the lower leg massage apparatus 1 disposed at the front of the seat portion 31 while having a back or neck massage performed by the back massage mechanism mounted within the seatback portion 33. The lower leg massage apparatus 1 may be detachably coupled to the seat portion 31.

[Third Embodiment]

Figure 6:
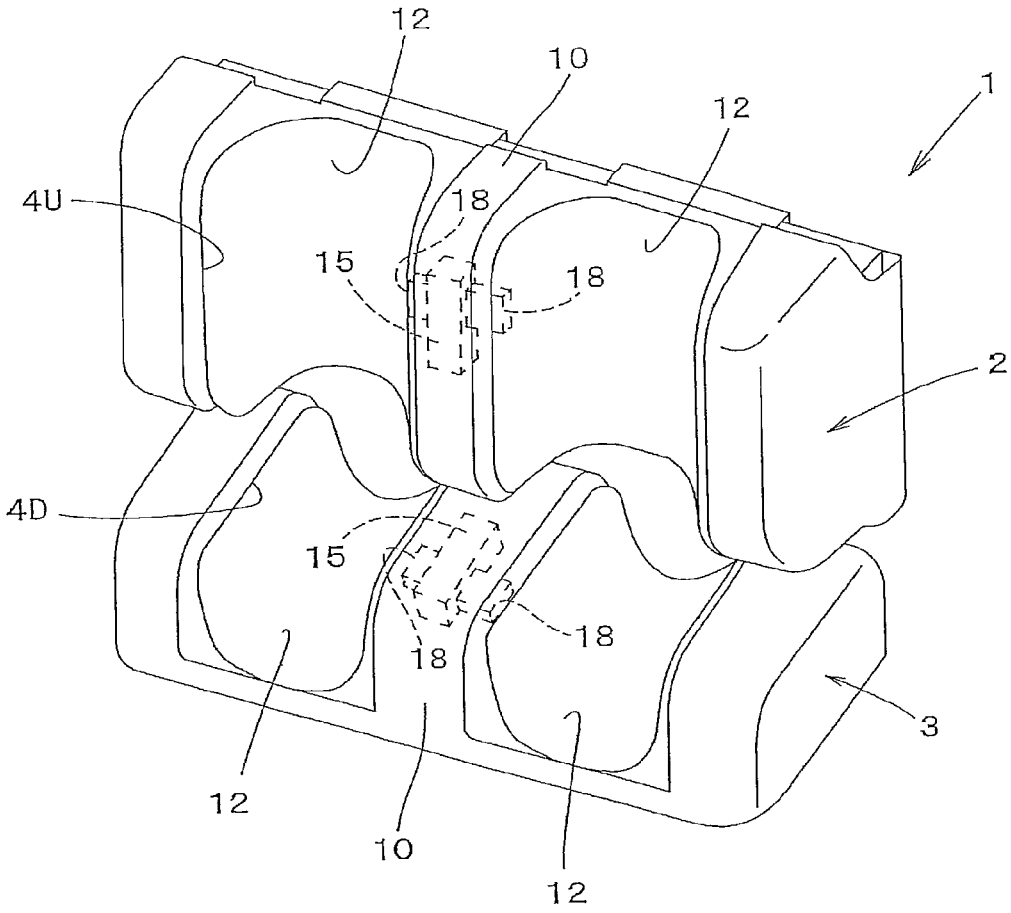
FIG. 6 is a perspective view of the lower leg massage apparatus in accordance with a third embodiment.
Figure 7:
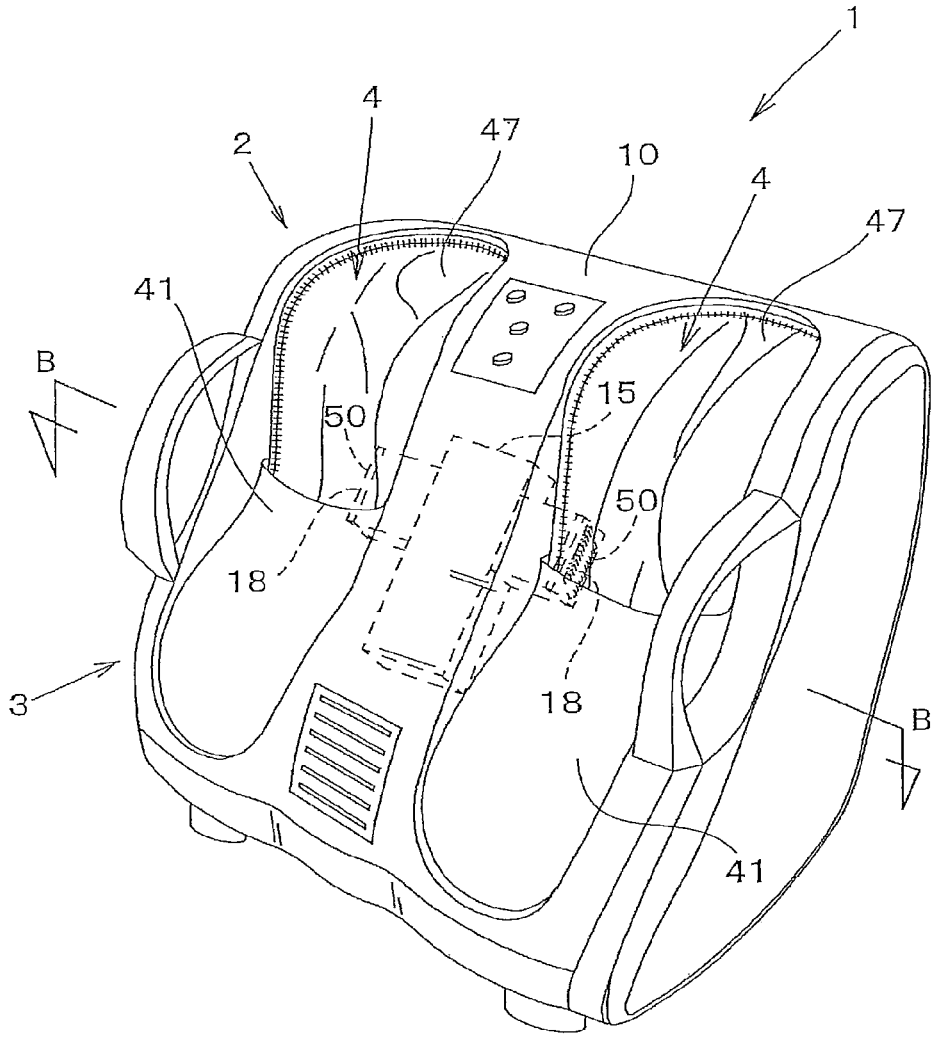
FIG. 7 is a perspective view of the lower leg massage apparatus in accordance with a fourth embodiment.
Figure 8:
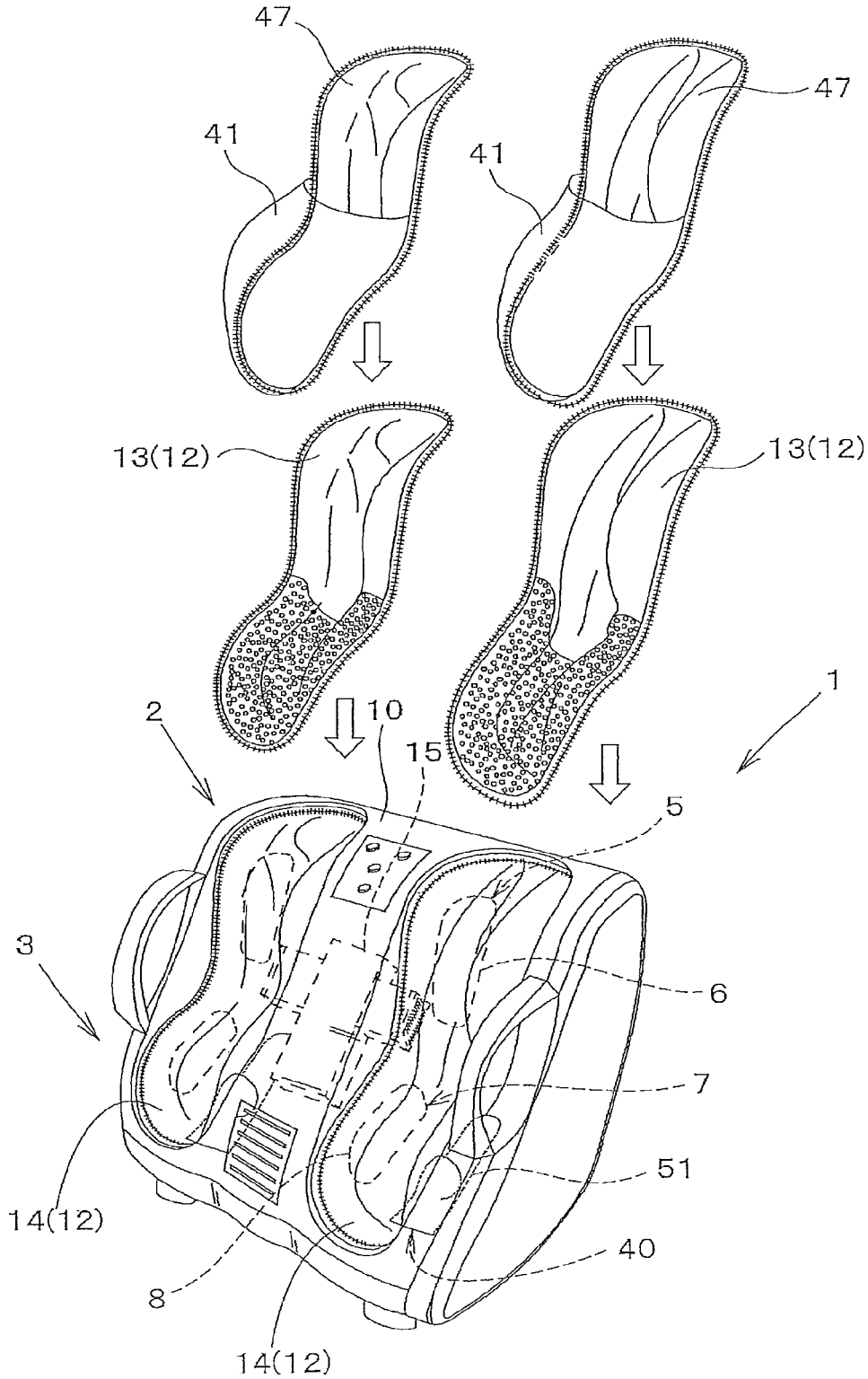
FIG. 8 is an exploded perspective view of the lower leg massage apparatus in accordance with the fourth embodiment.

In FIG. 6, there is shown a third embodiment of the lower leg massage apparatus pursuant to the present invention. The third embodiment is so designed that the leg rest portion 2 and the foot rest portion 3 are separate from each other. Moreover, it is advisable that insertion recesses 4 (first insertion recesses 4U) formed in the leg rest portion 2 and insertion recesses 4 (second insertion recesses 4D) formed in the foot rest portion 3 are each covered with the cover body 12 of a two-layer structure pursuant to the present invention. In this construction, a warm or cool current of air is delivered into each of the cover bodies 12 for covering the first insertion recesses 4U and the second insertion recesses 4D from a single or a plurality of warm air/cool air supply section/sections 15. Moreover, the insertion recess 4U and the insertion recess 4D may be integrally covered with a single cover body 12.

Moreover, although a mechanical massage mechanism is described as exemplary of the leg massage mechanism 5 as well as the foot massage mechanism 7 installed within the insertion recess 4, it is possible to adopt a pneumatic massage mechanism for effecting expansion and contraction by exploiting air. Further, there is no need to dispose both of the leg massage mechanism 5 and the foot massage mechanism 7 inside the insertion recess 4, and it is therefore possible to provide only one of the massage mechanisms. That is, in the alternative, the lower leg massage apparatus may be designed to have: a pair of right and left insertion recesses 4, 4 into which the lower legs L of a user are insertable; a massage mechanism disposed inside the insertion recess 4 for massaging the inserted lower legs L; a cover body 12 of a two-layer structure disposed in the insertion recess 4 so as to cover the massage mechanism; and a warm air/cool air supply section 15 for supplying a warm or cool current of air to a region between the two layers constituting the cover body 12.

[Fourth Embodiment]

In FIGS. 7 to 10, there is shown a fourth embodiment of the lower leg massage apparatus pursuant to the present invention.

The lower leg massage apparatus 1 of the fourth embodiment is substantially the same in basic structure as the first embodiment (refer to FIGS. 1 to 4). That is, the lower leg massage apparatus 1 of the fourth embodiment similarly includes a leg rest portion 2 having insertion recesses 4 into which are inserted the right and left calves C and a foot rest portion 3, disposed at the side of the front end of the leg rest portion 2, having insertion recesses 4 into which are inserted the right and left feet F. The leg rest portion 2 is provided with a leg massage mechanism 5 (first massage mechanism) for the calves C, and the foot rest portion 3 is provided with a foot massage mechanism 7 (second massage mechanism) for the feet F.

The insertion recess 4 is formed by creating an opening along the length of the lower leg to be inserted at the front surface of the casing 10 and covering this opening with a cover body 12. The cover body 12 consists of an upper cloth body 13 and a lower cloth body 14 placed beneath the upper cloth body 13 to take on a two-layer structure. Temperature-adjusted air (a warm or cool current of air) supplied from a warm air/cool air supply section 15 finds its way into a region between the upper cloth body 13 and the lower cloth body 14. Main points of difference of the lower leg massage apparatus 1 of the fourth embodiment from the first embodiment are the provision of an auxiliary massage mechanism 40 inside the lower part of the insertion recess 4 and the provision of a front-part cover body 41 for the insertion recess 4.

Figure 9:
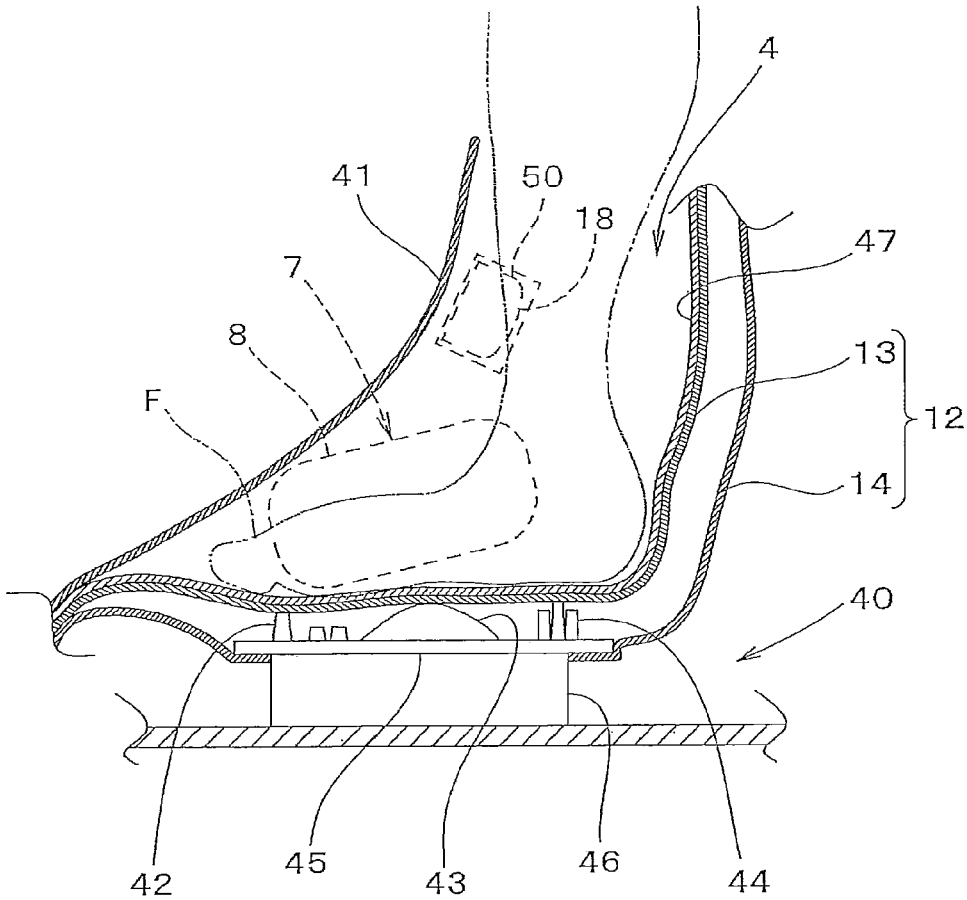
FIG. 9 is a sectional side view showing how the lower leg massage apparatus in accordance with the fourth embodiment is to be used.
Figure 10:
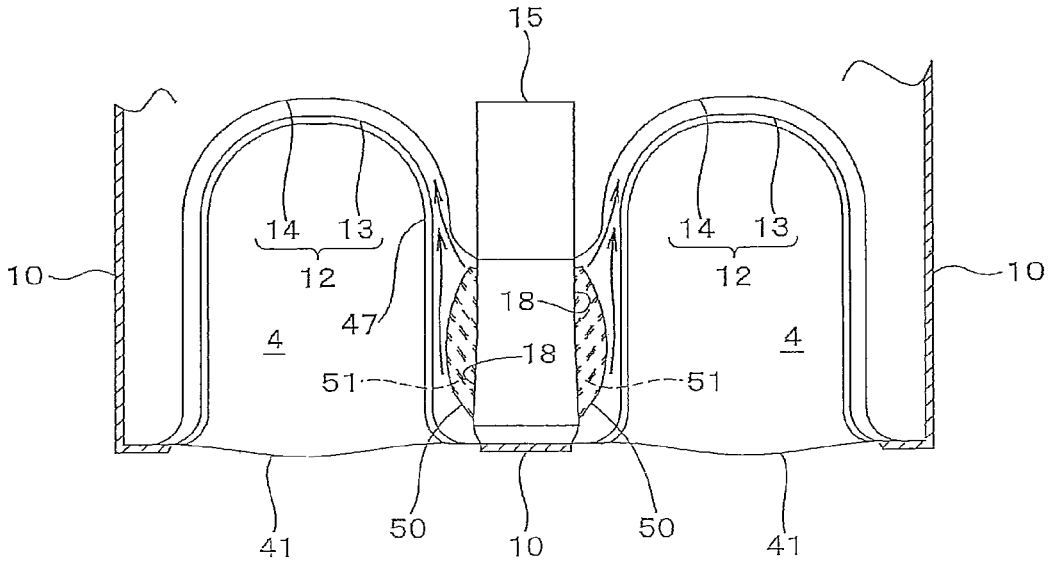
FIG. 10 is a sectional view of the lower leg massage apparatus taken along the line B-B shown in FIG. 7.

It will be apparent from FIG. 9 that the auxiliary massage mechanism 40 is disposed between the two layers (the upper cloth body 13 and the lower cloth body 14) constituting the cover body 12. The auxiliary massage mechanism 40 acts to massage the sole (the back of the foot F) of the lower leg inserted in the insertion recess 4. For example, by utilizing a vibrator (vibration generating machine) 46, it is possible to apply slight vibration to the sole and thereby produce effects of helping improve blood circulation and helping reduce muscle stiffness. In the illustrated example, the vibrator 46 develops vibration in a vibrating plate 45 having a front protrusion group 42 which abuts against the back of the tip of a toe, a projecting support 43 which abuts against the arch of a foot, and a rear protrusion group 44 which abuts against the bottom of a heel.

With the provision of the front protrusion group 42, the projecting support 43, and the rear protrusion group 44, a heightwise space area can be secured between the upper cloth body 13 and the lower cloth body 14 even when the foot F is placed on the upper cloth body 13 of the cover body 12. Another advantage of the heightwise space area resides in the effect of ensuring the flow of a warm or cool current of air supplied from the warm air/cool air supply section 15. The front-part cover body 41 is so disposed as to cover at least the foot F of the lower leg inserted in the insertion recess 4. The front-part cover body 41 may be made either of the same material as that used for the upper cloth body 13 and the lower cloth body 14 or of a different material. For example, the front-part cover body 41 may be formed of a stretchy and flexible cloth fabric, an artificial leather, a leather, a foamed urethane cloth material, a raised fabric, and so forth.

It is noted that, as a requirement for the selection of a material used for the front-part cover body 41, it is recommendable to direct attention to a highly hygroscopic material (sweat-absorbent material), a breathable material (material free from stuffiness and excessive temperature rise). The front-part cover body 41 is attached, with its outer edge aligned with the opening periphery of the insertion recess 4 or the peripheral edge of the cover body 12 (the upper cloth body 13 and the lower cloth body 14) in the casing 10, so as to extend over the opening defining the insertion recess 4. In this way, a pouch-like space area for accommodating the lower leg is created between the upper cloth body 13 of the cover body 12 and the front-part cover body 41.

In the construction shown as the fourth embodiment, the front-part cover body 41 is disposed at the front end of a replacement cover body 47. Specifically, the replacement cover body 47 is disposed in the insertion recess 4 so as to be laid on the upper cloth body 13 of the cover body 12. That is, the replacement cover body 47 is the third cloth body placed above the two-layer structure. The replacement cover body 47 should preferably be made of a highly hygroscopic and washable material. The front-part cover body 41 and the replacement cover body 47 are formed in a single-piece design by sewing together an edge of the front-part cover body 41 and a corresponding edge of the replacement cover body 47. In this way, a pocket for receiving the foot F can be created between the cover bodies 41 and 47. The lower leg is inserted into the insertion recess 4 so as for the foot F to be interposed between the front-part cover body 41 and the upper cloth body 13. This makes it possible to enhance the effect of keeping the foot F warm and thereby massage the lower leg L while keeping the foot F very warm.

It is noted that the front-part cover body 41 is not limited to the form of being sewn on the replacement cover body 47, but may be made detachable therefrom. In the warm air/cool air supply section 15, the outlet 18 through which a warm current of air issues is formed at a location slightly higher than a heightwise midpoint of the insertion recess 4. The outlet 18 is provided with a flow guide portion 50 for allowing a warm current of air to issue in a direction from the opening edge of the insertion recess 4 to the depths (inner part) of the insertion recess 4 to reach the space area between the upper cloth body 13 and the lower cloth body 14 (refer to FIG. 10). Specifically, a plurality of fins 51 inclined downward (inclined toward the interior of the lower leg massage apparatus 1) are provided along the traveling path of a warm current of air issuing from the outlet 18, and a gap for allowing the passage of a warm current of air is created between the fins 51, 51.

By providing such a flow guide portion 50, it is possible to avoid causing local high-temperature heating due to a direct hit of a warm current of air issuing from the outlet 18 on the lower leg inserted in the insertion recess 4. As employed herein, "direct hit" does not mean that the lower leg is directly hit by a warm current of air but means that a warm current of air issues in a direction toward the lower leg. In the fourth embodiment, as has already been described, since the lower leg massage apparatus is provided with the front-part cover body 41, the upper cloth body 13 is designed to have both a part pervious to a warm or cool current of air supplied from the warm air/cool air supply section 15 and a part impervious to a warm or cool current of air.

That is, in the upper cloth body 13, that part thereof which faces the foot F of the lower leg inserted in the insertion recess 4 (the region represented by a large number of small holes) is made pervious to a warm or cool current of air, and the rest is made impervious to a warm or cool current of air. By doing so, a warm current of air or a cool current of air travels directly to the foot F, with the consequence that the toe can be warmed up or cooled down effectively. It will be apparent from the heretofore given detailed explanation that the lower leg massage apparatus 1 of the fourth embodiment is provided with the auxiliary massage mechanism 40 and is thus capable of performing a massage also to the sole (the back of the foot F) of the lower leg inserted in the insertion recess 4. Moreover, with the provision of the front-part cover body 41, the heat-retaining property within the insertion recess 4 can be enhanced.

Otherwise, the fourth embodiment is substantially the same as the first embodiment (refer to FIGS. 1 to 4) in terms of use and the advantages of function, and therefore further detailed description thereof will be omitted.

[Fifth Embodiment]

Figure 11:
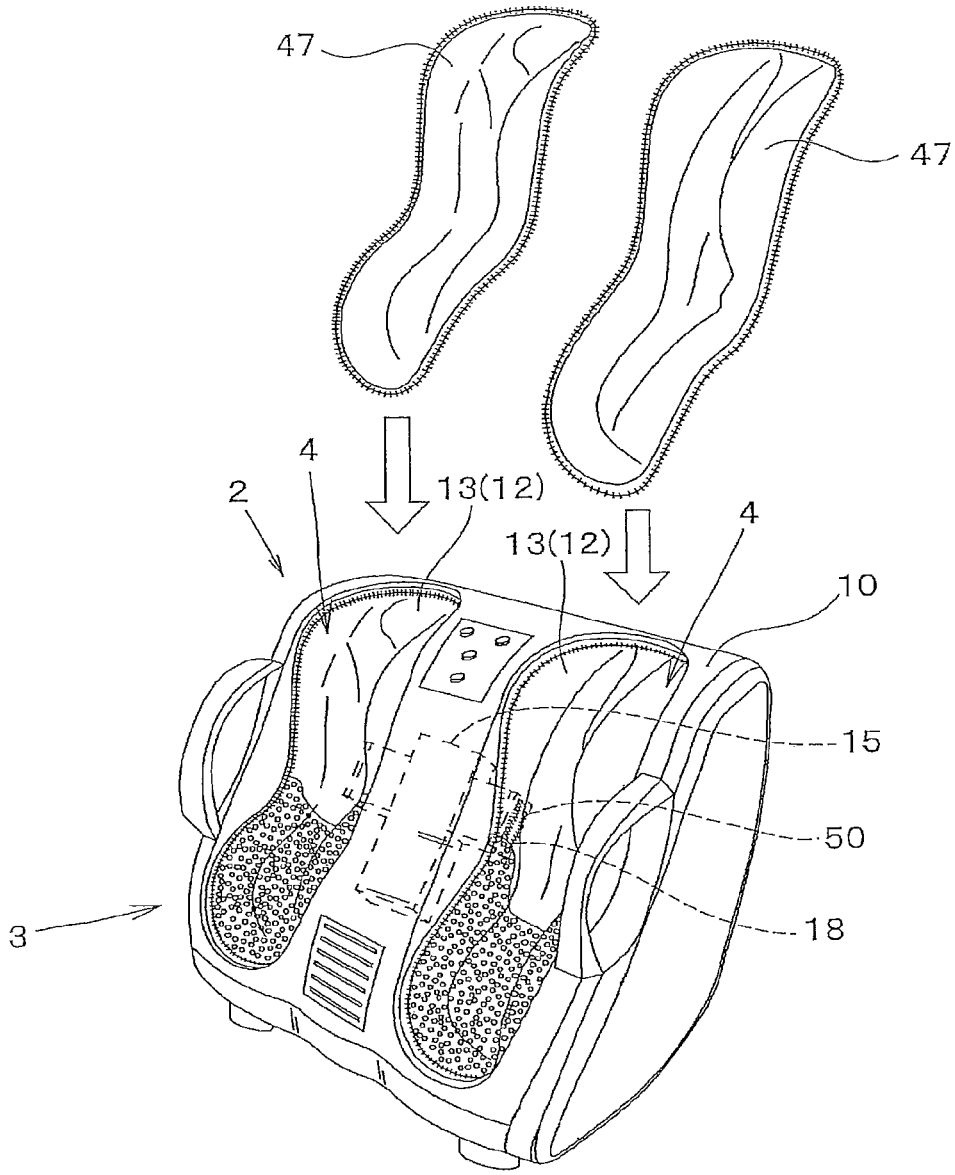
FIG. 11 is an exploded perspective view of the lower leg massage apparatus in accordance with a fifth embodiment.

In FIG. 11, there is shown a fifth embodiment of the lower leg massage apparatus pursuant to the present invention. The fifth embodiment is identical with the fourth embodiment (refer to FIGS. 7 to 10) except that, in the former, the replacement cover body 47 is devoid of the front-part cover body 41. Just like the fourth embodiment, the lower leg massage apparatus 1 of this embodiment has the advantage that the replacement cover body 47 is made detachable for washing and replacement.

[Sixth Embodiment]

Figure 12:
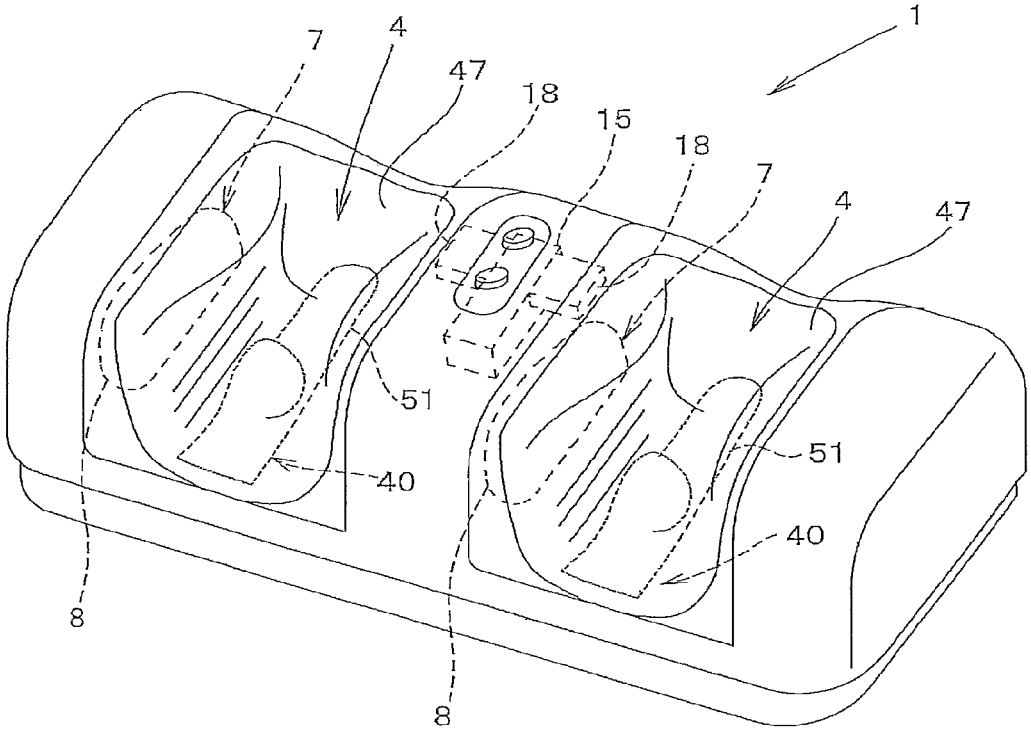
FIG. 12 is a perspective view of the lower leg massage apparatus in accordance with a sixth embodiment.

In FIG. 12, there is shown a sixth embodiment of the lower leg massage apparatus pursuant to the present invention.

Major points of difference of the sixth embodiment from the fifth embodiment are that the foot rest portion 3 is designed as a separate unit, and that the cover body 12 takes on a two-layer structure (consists of an upper cloth body 13 and a lower cloth body 14) and an auxiliary massage mechanism 40 (rotatable roller-type massage mechanism) is disposed under the two-layer structure of the cover body 12 (under the lower cloth body 14). Otherwise, the sixth embodiment is identical with the fifth embodiment (refer to FIG. 11), for example, the provision of a replacement cover body 47 over the cover body 12 having a two-layer structure. The lower leg massage apparatus 1 of this embodiment is substantially the same as the fifth embodiment in terms of use and the advantages of function, and therefore further detailed description thereof will be omitted.

[Seventh Embodiment]

Figure 13:
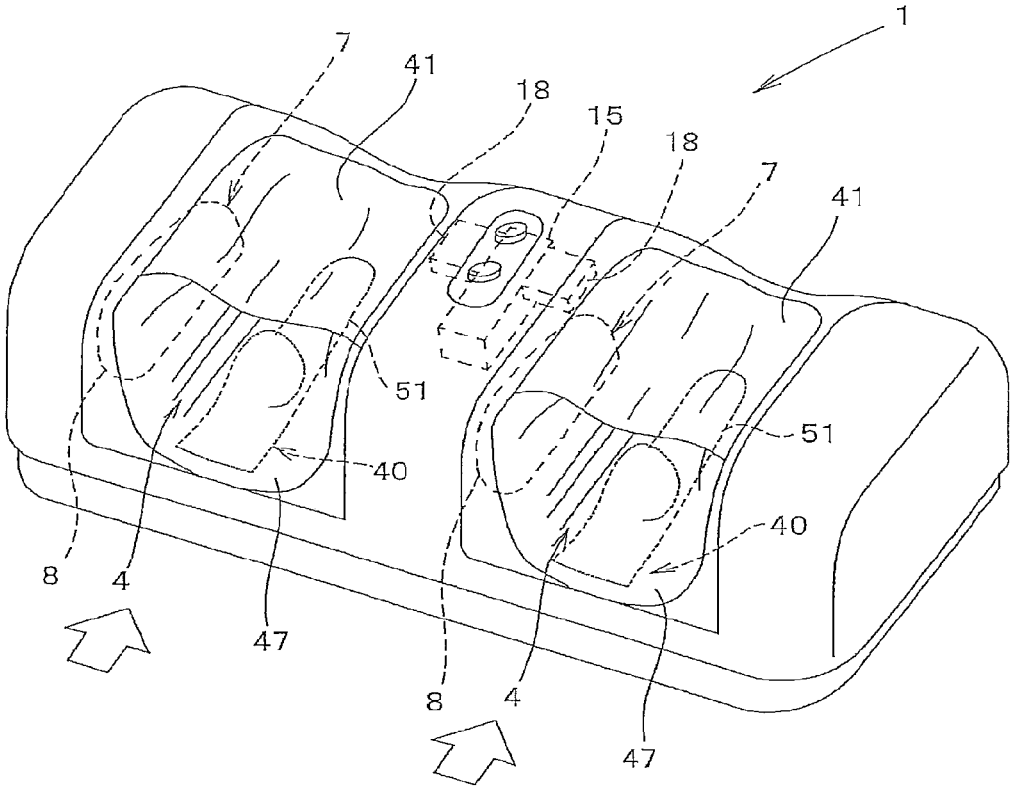
FIG. 13 is a perspective view of the lower leg massage apparatus in accordance with a seventh embodiment.

In FIG. 13, there is shown a seventh embodiment of the lower leg massage apparatus pursuant to the present invention.

Also in the seventh embodiment, just like the sixth embodiment, in terms of basic configuration, the foot rest portion 3 is designed as a separate unit. A point of difference of the seventh embodiment from the sixth embodiment is the provision of a front-part cover body 41 on the replacement cover body 47 of the insertion recess 4 as adopted in the sixth embodiment. The front-part cover body 41 is attached, with its outer edge aligned with the edge of the opening periphery of the insertion recess 4, so as to be laid over the insertion recess 4. By providing this front-part cover body 41, just as is the case with the fourth embodiment, a pocket can be created between the cover bodies 41 and 47. When inserted into this pocket, the leg can be given a massage while enhancing the effect of keeping the leg warm.

[Eighth Embodiment]

Figure 14:
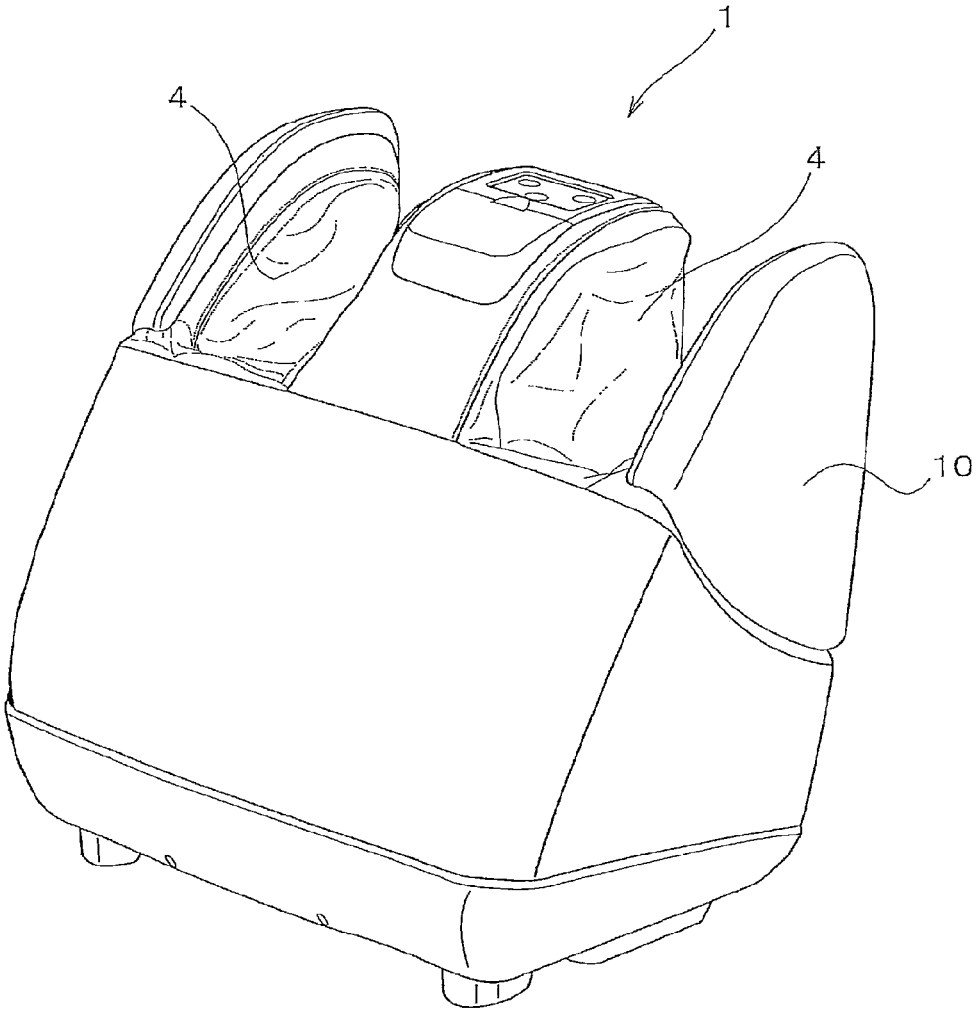
FIG. 14 is a perspective view of the lower leg massage apparatus in accordance with an eighth embodiment.
Figure 15A:
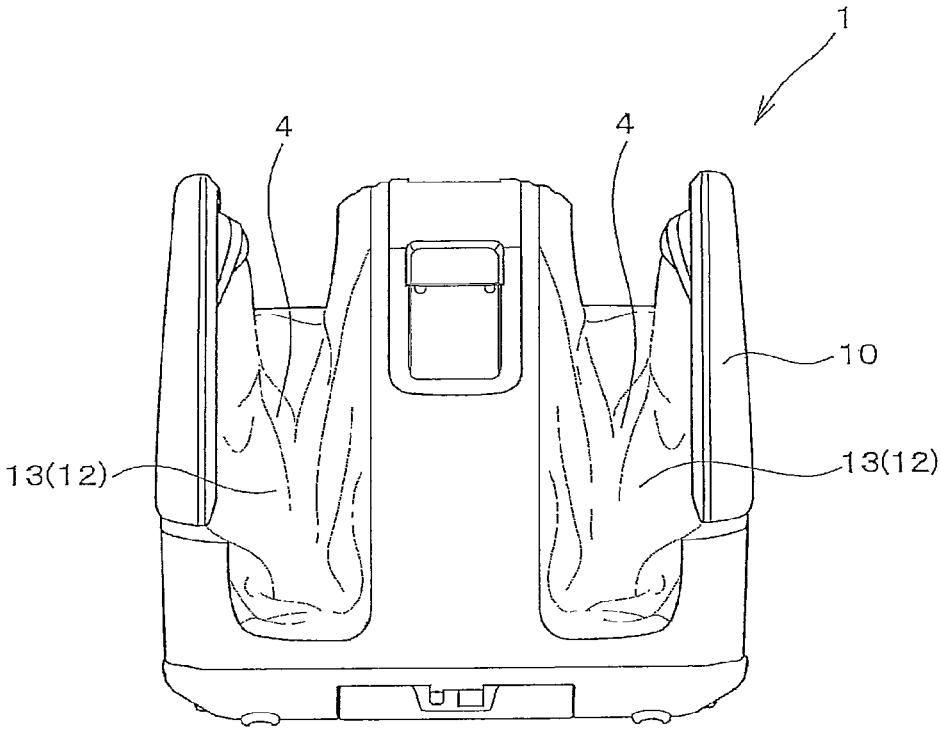
FIG. 15(*a*) is a back view of the lower leg massage apparatus in accordance with the eighth embodiment, and FIG. 15(*b*) is a right-hand side view of the lower leg massage apparatus in accordance with the eighth embodiment.
Figure 15B:
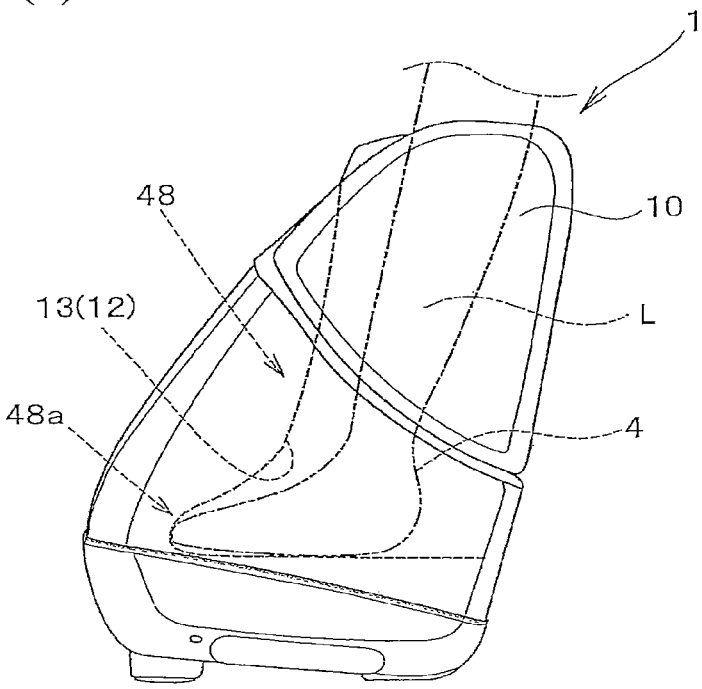

In FIGS. 14 and 15, there is shown an eighth embodiment of the lower leg massage apparatus pursuant to the present invention. FIG. 15(*a*) shows the back surface of the apparatus 1, and the left-hand part of FIG. 15(*b*) corresponds to the front side of the apparatus.

In contrast to the first embodiment in which the insertion recess 4 is disposed at the front of the casing 10, in the lower leg massage apparatus 1 of this embodiment, the insertion recess 4 is disposed at the back of the casing 10. Otherwise, the eighth embodiment is identical with the first embodiment, and therefore further descriptions thereof will be omitted. Since the insertion recess 4 is disposed at the back of the casing 10, as shown in FIG. 15(*b*), the lower leg L is inserted into the insertion recess 4 from its shin (front leg part). Moreover, in this embodiment, the lower part of an inner wall 48 of the insertion recess 4 (that part of the insertion recess 4 which is opposed to the tip of the toe) has a cross-sectional profile so as to cover the inserted foot F, thereby constituting a front-part cover portion 48*a*. The front-part cover portion 48*a* helps enhance the effect of keeping the foot F warm.

A cover body 12 having a two-layer structure of an upper cloth body 13 and a lower cloth body 14 is so formed as to extend from the front-part cover portion 48*a* to the upper part of the insertion recess 4 continuous therewith. Temperature-adjusted air (a warm or cool current of air) supplied from a warm air/cool air supply section 15 finds its way into the two-layer structure of the cover body 12. In this embodiment, it is possible to dispose an additional massage mechanism at that part of the inner wall 48 of the insertion recess 4 which is opposed to the front part of the lower leg L. Note that the lower leg massage apparatus of the present invention is not limited to the embodiments thus far described.

For example, there is no problem with the lower leg massage apparatus 1 disclosed by way of the fourth to eighth embodiments being provided as a foot rest of the chair-type massage apparatus 30.

The invention claimed is:

1. A lower leg massage apparatus comprising:

a pair of right and left insertion recesses adapted to have lower legs of a user be insertable therein; and a massage mechanism disposed within each of the insertion recesses, adapted to massage the lower legs when inserted in the recesses, a pair of right and left cover bodies of a two-layer structure, each of the cover bodies having a peripheral edge, the peripheral edge of the right cover body being attachable along an edge of the right insertion recess so as to cover the right insertion recess, and the peripheral edge of the left cover body being attachable along an edge of the left insertion recess so as to cover the left insertion recess, and further comprising:

a warm air/cool air supply section provided to supply a warm or a cool current of air to a region between the two layers constituting the cover body attached to each of the right and left insertion recesses, wherein each of the cover bodies consists of an upper cloth body and a lower cloth body placed beneath the upper cloth body, and the warm air/cool air supply section has an outlet which is positioned so as to be capable of directing an issue of the warm or the cool current of air into a region between the upper cloth body and the lower cloth body of each of the cover bodies, and wherein the lower cloth body of each of the cover bodies is made of a material impervious to the warm or the cool current of air supplied from the warm air/cool air supply section, and an auxiliary massage mechanism adapted to massage a sole of a foot when the inserted lower leg is disposed between the upper cloth body and the lower cloth body in each of the insertion recesses, and the upper cloth body is disposed so as to cover an upper part of the auxiliary massage mechanism.

2. The lower leg massage apparatus as set forth in claim 1, wherein the auxiliary massage mechanism is disposed at a bottom part of each of the right and left insertion recesses.

3. The lower leg massage apparatus as set forth in claim 1, wherein a portion of each of the cover bodies into which a calf of each of the lower legs is inserted is U-shaped, the U-shaped portion of each of the cover bodies is adapted to cover only a right lateral side, a left lateral side, and a back side of the calf of each of the lower legs, so that a portion of a front side of the calf between the right and left lateral side of each of the lower legs remains uncovered by any portion of the apparatus.

4. The lower leg massage apparatus as set forth in claim 1, wherein the outlet for the warm current of air is provided with a flow guide portion for allowing an issue of the warm current of air to be directed into a space area between the upper cloth body and the lower cloth body of the cover body attached to each of the right and left insertion recesses.

5. The lower leg massage apparatus as set forth in claim 1, wherein the warm air/cool air supply section is adapted to be interposed between the pair of the right and left insertion recesses in a position between a front facing portion of each of the inserted lower legs.

6. The lower leg massage apparatus as set forth in claim 1, wherein the upper cloth body in each of the right and left insertion recesses is made pervious to the warm or the cool current of air supplied from the warm air/cool air supply section.

7. The lower leg massage apparatus as set forth in claim 1, wherein the upper cloth body of each of the cover bodies is so designed such that a part thereof which faces the foot of the inserted lower leg in the each of the insertion recesses is made pervious to the warm or the cool current of the air supplied from the warm air/cool air supply section, and a remainder thereof is made impervious to the warm or the cool current of air.

8. The lower leg massage apparatus as set forth in claim 1, wherein the cover body attached to each of the right and left insertion recesses is provided with an opening for dissipating the warm or the cool current of air supplied from the warm air/cool air supply section.

9. The lower leg massage apparatus as set forth in claim 1, wherein each of the right and left insertion recesses is provided with a front-part cover body for covering the foot of each of the inserted lower legs.

10. The lower leg massage apparatus as set forth in claim 1, wherein each of the right and left insertion recesses is provided with a replacement cover body which covers the cover bodies of a two-layer structure from above, and is made replaceable.

11. The lower leg massage apparatus as set forth in claim 1, wherein, in order for the lower legs to be inserted from a rear, each of the right and left insertion recesses is disposed in an open form on a rear side, and a lower part of an inner wall of each of the insertion recesses is formed as a front-part cover body for covering the foot of each of the inserted lower legs.

12. A lower leg massage apparatus comprising:

a pair of right and left insertion recesses designed in a vertically-extending continuous form, adapted to have feet and calves of a user be insertable therein;

a first massage mechanism disposed within an upper part of each of the insertion recesses, adapted to massage the calves when inserted in the recesses; and a second massage mechanism disposed within a lower part of each of the insertion recesses, for massaging an inserted foot, a pair of right and left cover bodies of a two-layer structure, each of the cover bodies having a peripheral edge, and the peripheral edge of the right cover body being attachable along an edge of the right insertion recess so as to cover the right insertion recess, and the peripheral edge of the left cover body being attachable along an edge of the left insertion recess so as to cover the left insertion recess , and further comprising:

a warm air/cool air supply section provided to supply a warm or a cool current of air to a region between the two layers constituting the cover body attached each of the right and left insertion recesses, wherein each of the cover bodies consists of an upper cloth body and a lower cloth body placed beneath the upper cloth body, the warm air/cool air supply section has an outlet which is positioned so as to be capable of directing an issue of the warm or the cool current of air into a region between the upper cloth body and the lower cloth body of each of the cover bodies, and wherein the lower cloth body of each of the cover bodies is made of a material impervious to the warm or the cool current of air supplied from the warm air/cool air supply section, and an auxiliary massage mechanism adapted to massage a sole when the inserted foot is disposed between the upper cloth body and the lower cloth body in each of the insertion recesses, and the upper cloth body is disposed so as to cover an upper part of the auxiliary massage mechanism.

13. The lower leg massage apparatus as set forth in claim 12, wherein each of the insertion recesses includes an upper-located first insertion recess and a lower-located second insertion recess, and the cover body in each of the right and left insertion recesses covers the first insertion recess and the second insertion recess, either in a separate manner or in an integral manner.

14. The lower leg massage apparatus as set forth in claim 12, wherein the auxiliary massage mechanism is disposed at a bottom part of each of the right and left insertion recesses.

15. The lower leg massage apparatus as set forth in claim 2, wherein a portion of each of the cover bodies into which the calf of each of the lower legs is inserted is U-shaped, the U-shaped portion of each of the cover bodies is adapted to cover only a right lateral side, a left lateral side, and a back side of the calf of each of the lower legs, so that a portion of a front side of the calf between the right and left lateral side of each of the lower legs remains uncovered by any portion of the apparatus.

16. The lower leg massage apparatus as set forth in claim 12, wherein the cover body in each of the right and left insertion recesses is provided with an opening for dissipating the warm or the cool current of air supplied from the warm air/cool air supply section.

17. The lower leg massage apparatus as set forth in claim 12, wherein each of the right and left insertion recesses is provided with a front-part cover body for covering the foot of each of the inserted lower legs.

18. The lower leg massage apparatus as set forth in claim 12, wherein each of the right and left insertion recesses is provided with a replacement cover body which covers the cover bodies of a two-layer structure from above, and is made replaceable.

19. The lower leg massage apparatus as set forth in claim 12, wherein, in order for each of the lower legs to be inserted from the rear, each of the right and left insertion recesses is disposed in an open form on a rear side, and a lower part of an inner wall of each of the right and left insertion recesses is formed as a front-part cover body for covering the foot of each of the inserted lower legs.

* * * * *